US008375611B2

(12) United States Patent
Mandica et al.

(10) Patent No.: US 8,375,611 B2
(45) Date of Patent: Feb. 19, 2013

(54) CLOTHING IRON COMPRISING A SOLE HAVING A RECESS EQUIPPED WITH STEAM EXIT HOLES

(75) Inventors: Franck Mandica, Francheville le Haut (FR); Dominique Gelus, Pont-Eveque (FR); Stéphanie Pessayre, Corbas (FR)

(73) Assignee: SEB S.A., Ecully (FR)

( * ) Notice: Subject to any disclaimer, the term of this patent is extended or adjusted under 35 U.S.C. 154(b) by 205 days.

(21) Appl. No.: 12/943,463

(22) Filed: Nov. 10, 2010

(65) Prior Publication Data

US 2011/0107625 A1 May 12, 2011

(30) Foreign Application Priority Data

Nov. 12, 2009 (FR) ..... 09 05432

(51) Int. Cl.
*D06F 75/38* (2006.01)
*D06F 75/24* (2006.01)

(52) U.S. Cl. ..... 38/93

(58) Field of Classification Search ..... 38/74–83, 38/88, 93; 219/246, 259
See application file for complete search history.

(56) References Cited

U.S. PATENT DOCUMENTS

| | | | | | |
|---|---|---|---|---|---|
| 277,193 | A | * | 5/1883 | Ball | 38/93 |
| 1,859,167 | A | | 5/1932 | Prenzel | |
| 2,744,344 | A | | 5/1956 | Jepson | |
| 2,864,185 | A | * | 12/1958 | Vance | 38/75 |
| 3,045,371 | A | | 7/1962 | Kurlinski | |
| 3,238,650 | A | | 3/1966 | Mullen | |
| 3,742,629 | A | * | 7/1973 | Plasko | 38/69 |
| 4,532,411 | A | | 7/1985 | Terraillon et al. | |
| 4,685,229 | A | * | 8/1987 | Moravek et al. | 38/84 |
| 4,851,642 | A | * | 7/1989 | Wilkins | 392/399 |
| 4,875,249 | A | * | 10/1989 | Collier | 15/398 |
| D312,905 | S | * | 12/1990 | Davidson et al. | D32/71 |
| 5,787,614 | A | * | 8/1998 | Stutzer | 38/77.1 |
| 5,799,422 | A | | 9/1998 | Demuth et al. | |
| 6,260,295 | B1 | | 7/2001 | Nickel | |
| 7,516,566 | B2 | | 4/2009 | Yu | |
| 7,661,212 | B2 | | 2/2010 | Hahn | |
| D622,457 | S | * | 8/2010 | Choi | D32/17 |
| 2010/0031707 | A1 | * | 2/2010 | Krebs et al. | 68/222 |

FOREIGN PATENT DOCUMENTS

| | | | |
|---|---|---|---|
| DE | 4107236 | A1 | 9/1992 |
| FR | 2752853 | A1 | 3/1998 |
| GB | 2385603 | A | 8/2003 |
| JP | 7008696 | A | 1/1995 |
| WO | 2006051099 | A1 | 5/2006 |

* cited by examiner

*Primary Examiner* — Ismael Izaguirre
(74) *Attorney, Agent, or Firm* — The Webb Law Firm

(57) ABSTRACT

Clothing iron including a sole (1) having a bottom side with a sliding surface (11) coming into contact with cloth and comprising at least one steam-supplied recess (10), the recess (10) being bounded on its entire periphery by the sliding surface (11) in such a manner that the recess (10) forms a steam diffusion cavity that is surrounded by the sliding surface (11) when the sole (1) is applied to the cloth being ironed, characterized in that the sliding surface (11) represents less than 50% of the total surface of the bottom side of the sole (1).

14 Claims, 5 Drawing Sheets

CLOTHING IRON COMPRISING A SOLE HAVING A RECESS EQUIPPED WITH STEAM EXIT HOLES

BACKGROUND OF THE INVENTION

1. Field of the Invention

The present invention relates to a clothing iron and more particularly to a clothing iron comprising a sole of a particular shape.

2. Description of the Prior Art

French patent #2 752 853, filed by the applicant, discloses a clothing iron comprising a sole having a central recess bounded on its entire periphery by a sliding surface coming in contact with cloth, wherein the recess and the sliding surface are equipped with numerous steam exit holes. Such a sole has the advantage of enabling the creation of a steam cushion in the cavity formed by the recess, enabling a more efficient dispensing of the steam to the cloth, and of possessing a smaller sliding surface, which in turn reduces friction. In particular this document teaches that a sliding surface representing at least 60% of the total surface of the sole is sufficient for ensuring proper drying of the cloth, the sole illustrated in FIG. 1 having a sliding surface representing around 75% of the total surface.

Such a clothing iron sole, however, has the disadvantage of being relatively expensive to manufacture for achieving ironing performances that are only slightly better than those achieved with less expensive to manufacture, standard flat soles.

The object of the present invention is to propose a steam iron comprising a pressing sole capable of achieving notably improved ironing performances. Another object of the invention is to propose a clothing iron capable of achieving better ironing performances with less energy expenditure.

SUMMARY OF THE INVENTION

To this end, the invention has as an object a clothing iron comprising a sole with a bottom side having a sliding surface coming into contact with cloth and comprising at least one recess supplied with steam, said recess being bounded on its entire periphery by the sliding surface in such a manner that the recess forms a steam diffusion cavity that is surrounded by the sliding surface when the sole is applied to the cloth being ironed, characterized in that the sliding surface represents less than 50% of the total surface of the bottom side of the sole.

In fact, the applicant discovered, in a surprising manner, that a sliding surface reduced to less than 50% of the total surface of the sole enabled a remarkable increase in ironing performances. This may be explained by the fact that reducing the sliding surface makes it possible, for a given sole size, to increase the surface of the steam diffusion cavity, which makes it possible to impregnate a larger surface area of the cloth with steam.

Furthermore, reducing the sliding surface also makes it possible to increase the pressure exerted by the weight of the iron on the cloth in the vicinity of the sliding surface, which results in better traction on the cloth fiber during ironing by scraping the fiber, restricting the diffusion of steam in the vicinity of the sliding surface in such a manner that the steam can only escape from the cavity by penetrating the cloth, thereby thoroughly impregnating the cloth.

According to another characteristic of the invention, the depth of the recess is between 1 and 5 mm.

According to still another characteristic of the invention, the bottom of the recess consists of a flat surface equipped with steam exit holes.

According to another characteristic of the invention, the sliding surface is not equipped with steam exit holes.

Such a characteristic makes it possible to obtain a sliding surface capable of optimally drying the cloth moistened by the steam diffused in the recess.

According to other special embodiments, the clothing iron of the invention can be configured according to one or several of the following combinations taken separately, or according to all of the combinations technically possible:

- the sliding surface represents between 30 and 45% of the total surface of the bottom side of the sole;
- the sliding surface is disposed on the periphery of the sole;
- the sliding surface is constituted by a flat strip extending along the contour of the sole;
- the flat strip has a width less than 3 cm;
- the recess comprises a steam emission zone in a front tip of the sole equipped with steam exit holes;
- the sliding surface of the sole comprises protrusions that locally reduce [the surface of the recess] behind the steam emission zone of the front tip of the sole;
- the sliding surface is equipped with steam exit holes only in the front tip of the sole;
- the sole comprises only one recess, said recess occupying a central position on the sole;
- the sole comprises a plurality of different recesses;
- the recess comprises protruding embossed elements in its bottom, which come into contact with the cloth when the sole is applied to the cloth being ironed;
- the embossed elements have an elongate shape.

The invention also relates to an ironing appliance comprising a pressurized steam generator connected by a steam line to a clothing iron such as the one previously described.

BRIEF DESCRIPTION OF THE DRAWINGS

The objects, aspects, and advantages of the present invention will emerge more clearly from the following description of a particular embodiment of the invention, which is presented as a nonlimiting example, with reference to the appended drawings, in which.

DETAILED DESCRIPTION OF THE INVENTION

Figure 1:
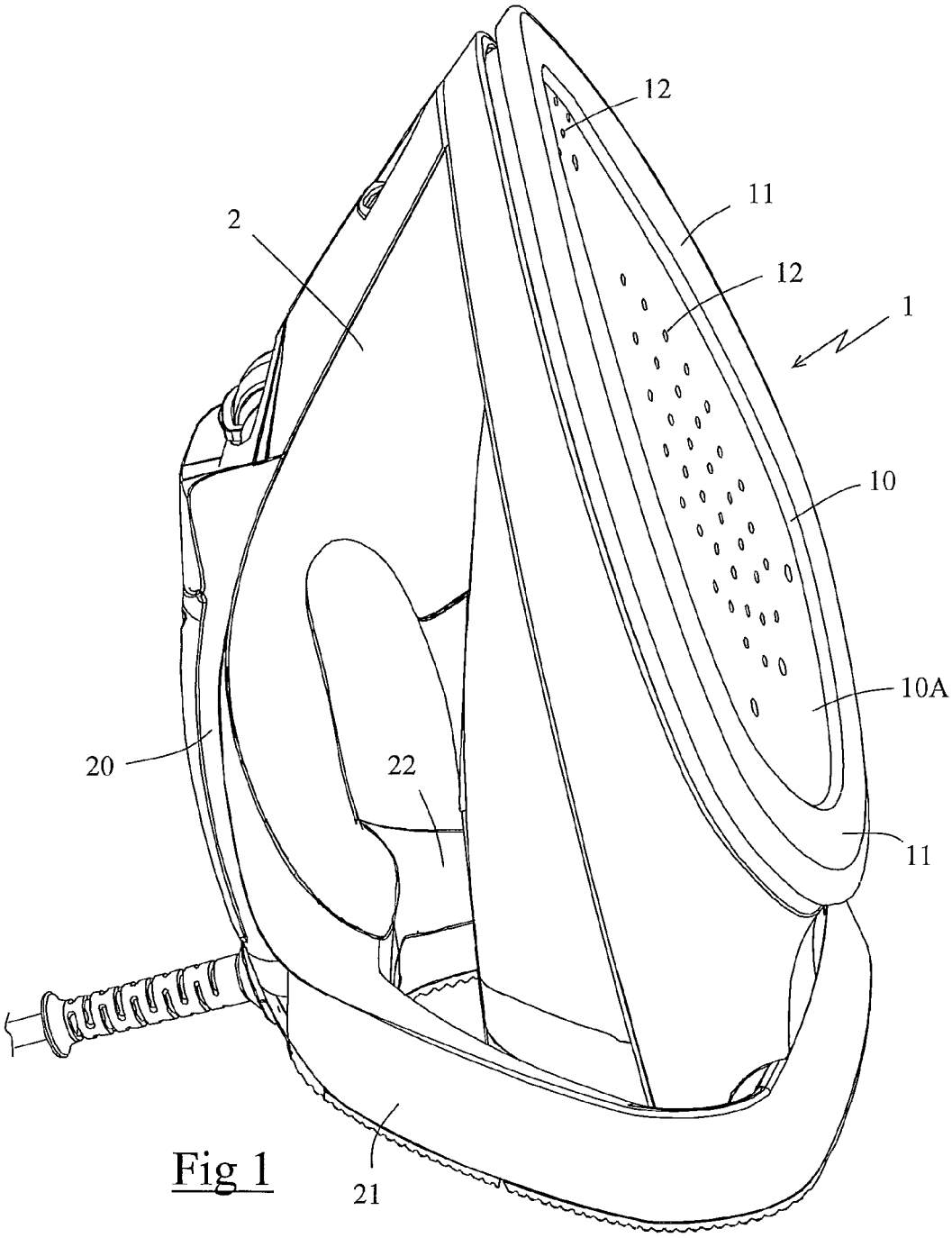
FIG. 1 is a perspective view of a steam iron according to a particular embodiment of the invention.
Figure 2:
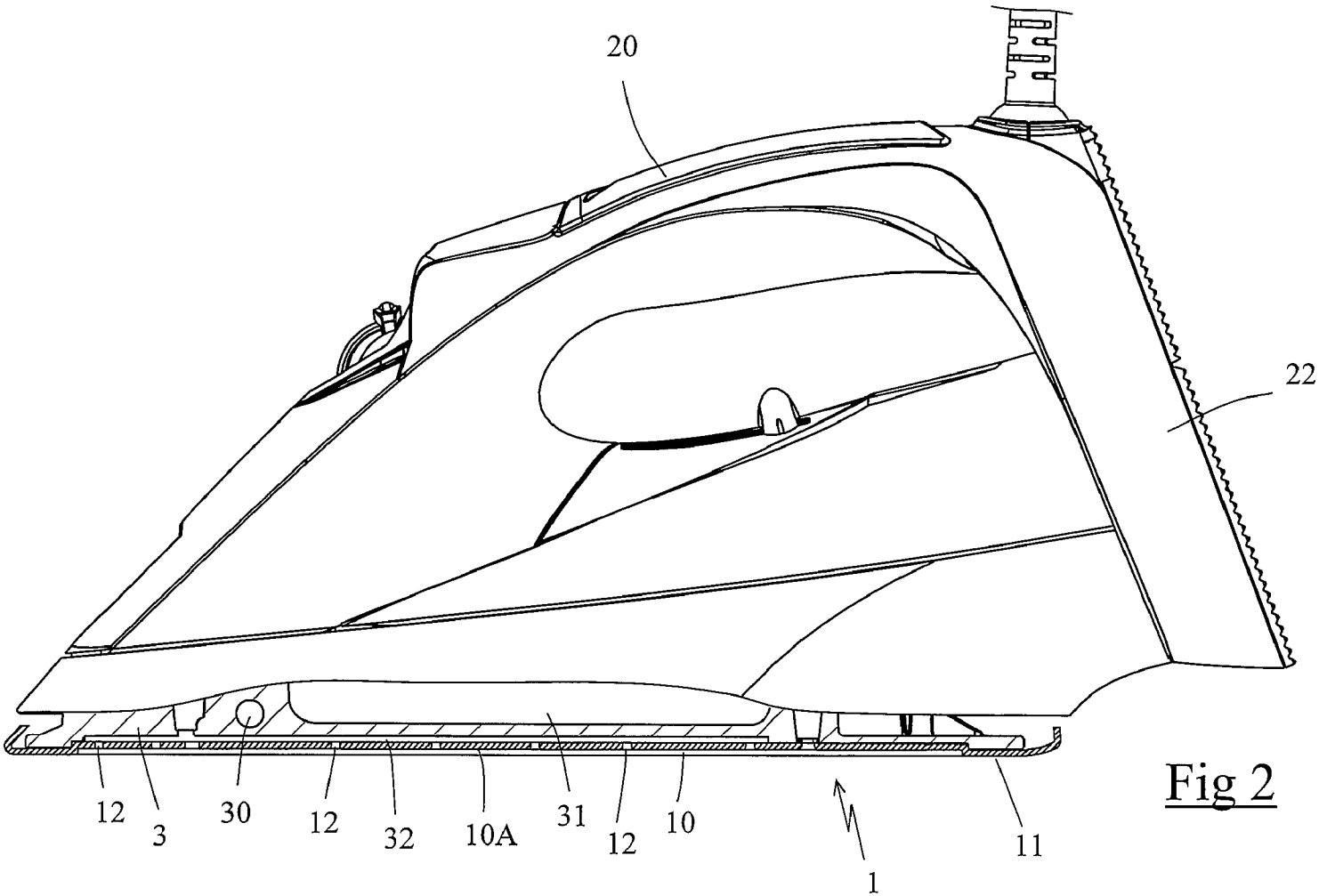
FIG. 2 is a side view of the steam iron of FIG. 1, in which the base of the housing is partially detached in order to reveal a longitudinal section of the heating element of the sole.

FIGS. 1 and 2 show a steam iron comprising a pressing sole 1 advantageously made of stainless steel. The sole 1 is surmounted by a plastic housing 2 enclosing, in a manner known per se, a water tank. The housing 2 comprises a handle 20 connected on one end to the front part of the iron and on the other end to two linkage arms 21, 22 symmetrically extending to the back of the iron, said two arms 21, 22 forming a heel on which the iron can rest vertically during inactive phases of the ironing process.

The housing 2 encloses a heating element 3 constituted by an aluminum casting disposed in thermal contact with the top side of the sole 1, the heating element 3 having an electrical resistor 30 and a vaporization chamber 31 for generating steam. The housing 2 also encloses, in a manner known per se, means for supplying the vaporization chamber with water from the tank, said means advantageously consisting of a drip valve or a pump and not shown in the figures.

According to FIGS. 1 through 4, the sole 1 has a standard shape, the sole 1 comprising a front tip connected by diverging, curved lines to a rounded, back end. The bottom side of the sole 1 comprises a recess 10, the outer contour of which essentially matches the contour of the sole 1, wherein said recess 10 comprises a bottom 10A set back relative to a sliding surface 11 extending along the perimeter of the sole 1, said sliding surface 11 being designed to come into contact with the cloth during the active phases of the ironing process.

The bottom 10A of the recess is appreciably flat and is equipped with steam exit holes 12 connected to the vaporization chamber 31 by a dispensing chamber 32 formed on the bottom side of the heating element 3. The recess 10 thus constitutes a steam diffusion cavity that is surrounded by the sliding surface 11 and in which the steam is trapped when the sole 1 is applied to the cloth being ironed.

Figure 3:
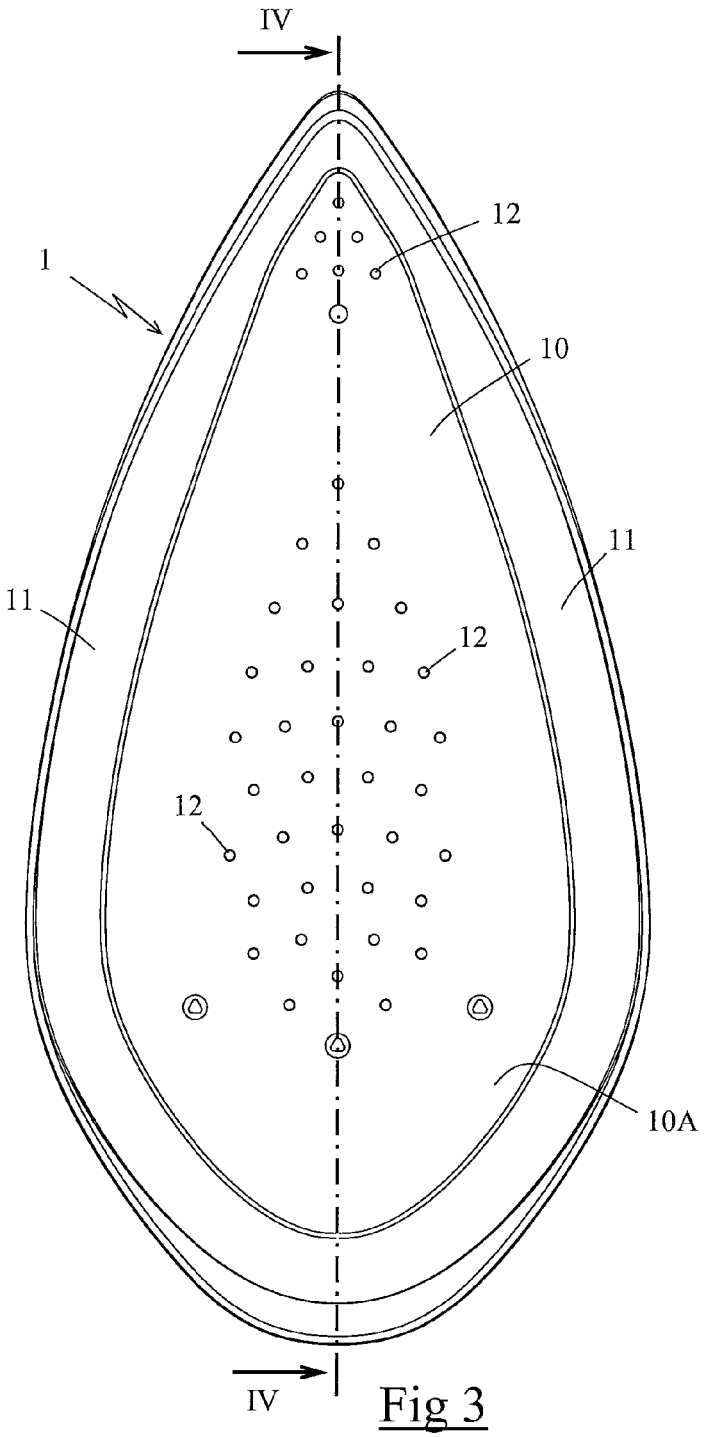
FIG. 3 is a bottom view of the sole of the iron of FIG. 1.

According to FIG. 3, the steam exit holes 12 are advantageously distributed in two groups, a first group comprising more than thirty steam exit holes 12 distributed in the central area of the sole and a second group comprising a smaller number of steam exit holes 12 arranged in proximity to the front tip of the sole 1 in such a manner as to favor a more thorough impregnation of the steam in these two areas of the sole 1.

More particularly according to the invention, the sliding surface 11 of the sole represents less than 50% of the total surface of the bottom side of the sole 1 and preferably between 30 and 45% of the total surface of the bottom side of the sole 1. For example, the sliding surface of the sole illustrated in FIG. 3 represents only 36% of the total surface of the bottom side of the sole 1, whereas the surface of the recess represents 64% of the total surface of the bottom side of the sole 1.

Such a characteristic makes it possible to obtain, in the vicinity of the sliding surface 11, a pressure exerted on the fabric being ironed of sufficient magnitude for restricting the diffusion of steam under the sliding surface 11. Hence a pressurized steam cushion forms under the sole 1 of the iron, ensuring a thorough impregnation of the cloth with steam.

Preference is given to the recess 10 having a depth of between 1 and 5 mm and advantageously of around 1.5 mm. In fact, the applicant discovered that when the recess 10 has a depth less than 1 mm, the steam cushion does not ensure sufficient moistening of the cloth for effective ironing. In contrast, when the depth of the recess 10 is greater than 5 mm, the heat radiated by the bottom 10A of the flat recess 10 is then insufficient for effectively contributing to the drying of the cloth, and therefore the cloth may still be too wet after ironing.

In particular, the depth of the recess is determined as a function of the emissivity of the material used to make the surface of the sole; the higher the emissivity of the material, the greater the depth of the recess. For example, for the case of a sole made of stainless steel, the depth of the recess will preferably be around 1.5 mm, the low emissivity of the stainless steel enabling a thorough moistening of the cloth by the steam cushion because of the weak radiation emitted by the bottom of the recess. In contrast, for the case of a sole with an enamel coating, preference will be given to a recess depth of around 4 mm in order to limit the energy released by radiation by the bottom of the recess.

Advantageously, the sliding surface 11 is not equipped with steam exit holes. Such a characteristic makes it possible to prevent steam from diffusing under the sliding surface 11 and guarantees an optimum drying of the cloth after the thorough moistening thereof by the steam cushion formed in the recess 10.

Preference is given to the sliding surface 11 having the shape of a flat strip less than 3 cm in width extending along the perimeter of the sole 1. For example, the sliding surface 11 of the sole illustrated in FIGS. 1 through 4 consists of a flat strip of around 1.5 cm in width, this width being reduced in the vicinity of the front tip of the sole 1.

Such a sole makes it possible to ensure a high ironing efficiency, as the small sliding surface in contact with the cloth improves the sliding of the sole and the recess enables the formation of a steam cushion in which the speed of the steam flow is reduced relative to the speed at the steam exit holes, thus ensuring a thorough impregnation of the cloth with steam over the entire surface of the recess before the sliding surface, which is not equipped with steam exit holes, dries the cloth.

This improved impregnation of the cloth also makes it possible to obtain a more energy efficient steam iron, the steam produced by the iron being, for the most part, used to moisten the cloth rather than diffused into the air. The use of such a pressing sole thus makes it possible to obtain an equivalent ironing efficiency with an iron possessing a lesser steam flow rate and therefore less power.

Figure 4:
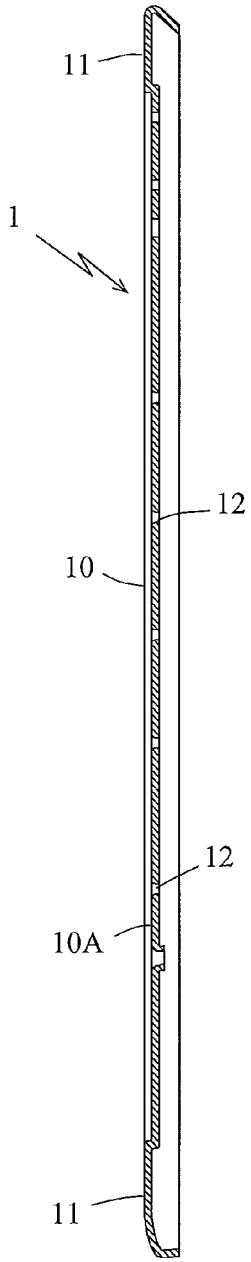
FIG. 4 is a cutaway view along the line IV-IV of the sole of FIG. 3.
Figure 5:
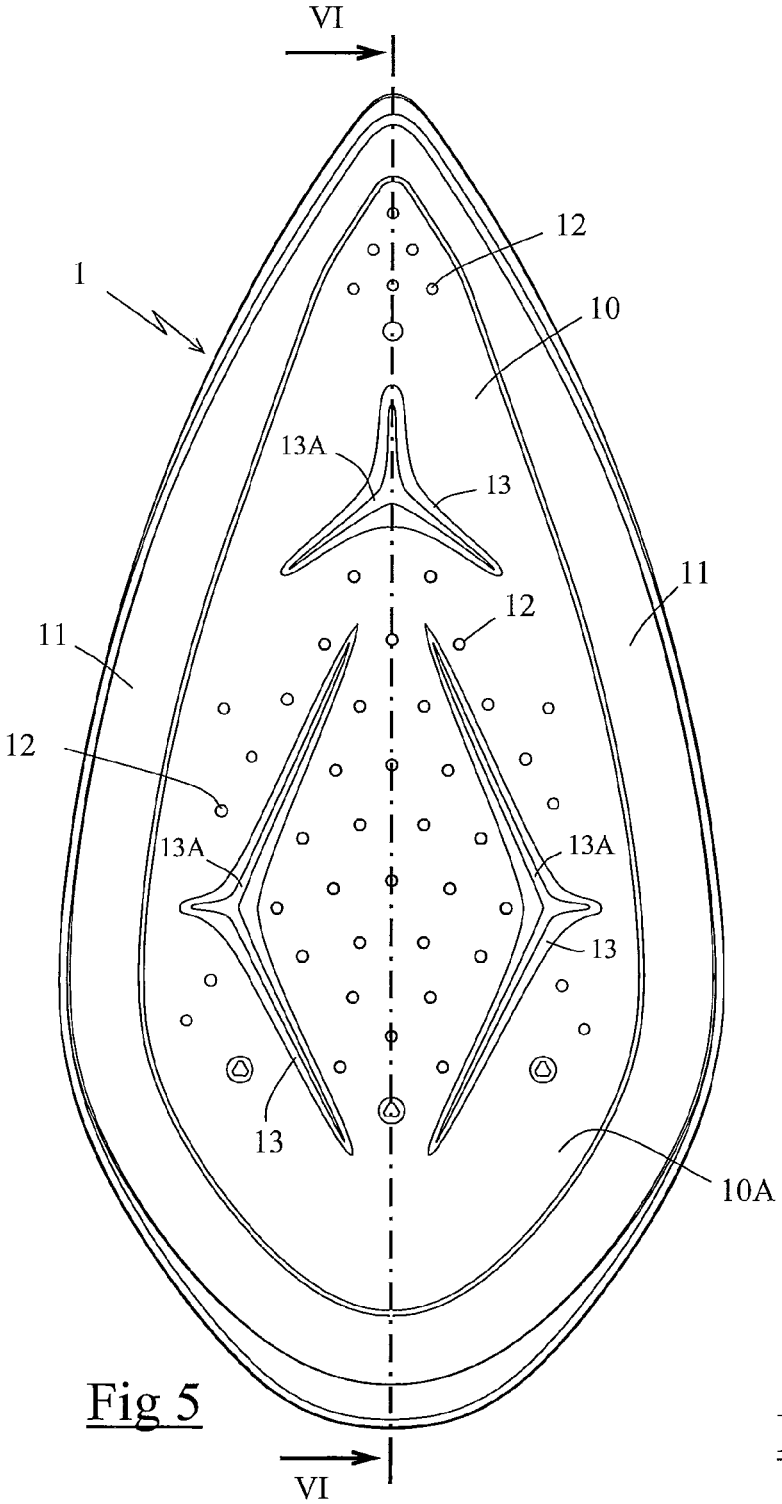
FIG. 5 is a bottom view of a variant of embodiment of the sole of FIG. 3.
Figure 6:
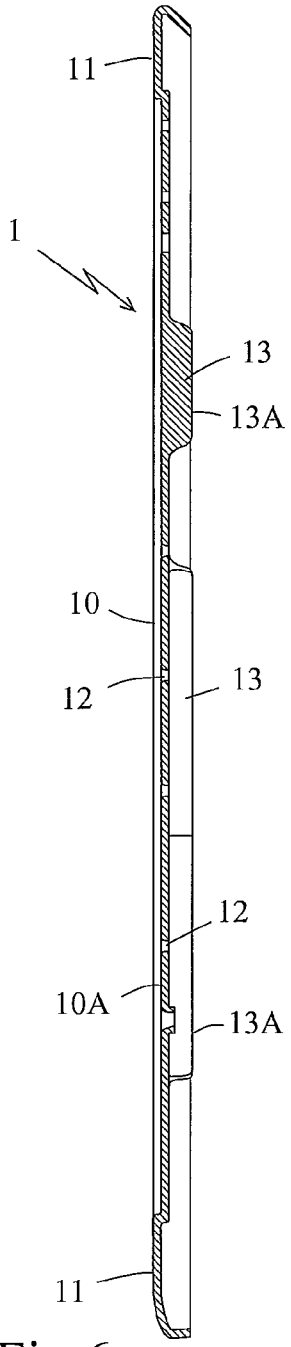
FIG. 6 is a cutaway view along the line VI-VI of the sole of FIG. 5.

FIGS. 5 and 6 represent a variant of embodiment of the pressing sole illustrated in FIGS. 3 and 4, said pressing sole being designed to equip the iron of FIG. 1. In this variant of embodiment, the recess 10 locally comprises protruding embossed elements 13 in the middle of the recess 10, the height of the embossed elements being such that the peak of the embossed element 13 reaches or extends slightly above the sliding surface 11 defining the perimeter of the sole 1.

The top end of the embossed elements 13 comprises a sliding surface 13A coming into contact with the cloth during ironing operations, with preference being given to the embossed elements 13 having several branches arranged in a star pattern, wherein each branch advantageously has a width less than 1 cm so as to constitute scrapers that tighten the cloth as the iron is moved.

Figure 7:
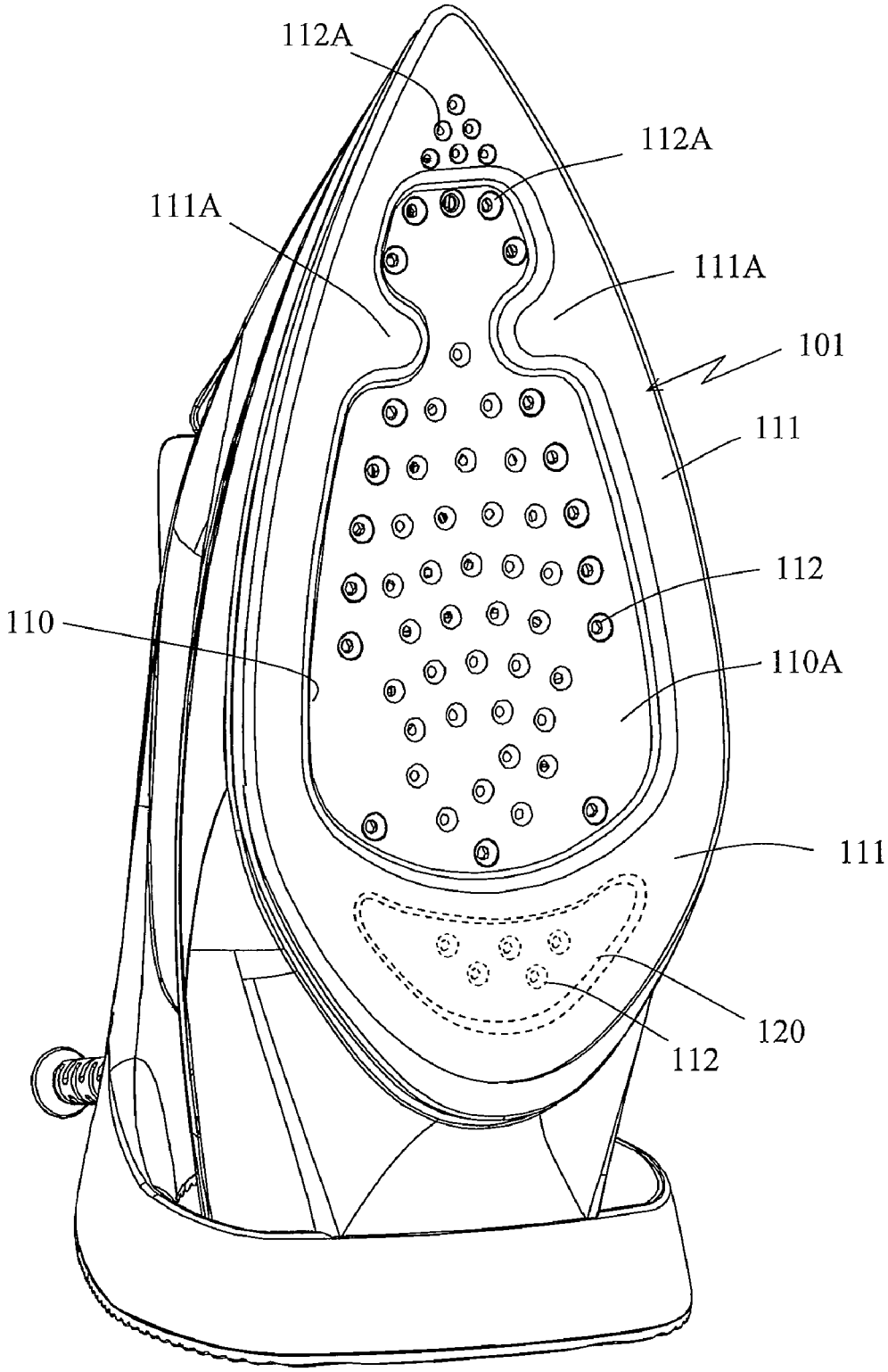
FIG. 7 is a perspective view of an iron according to another particular embodiment of the invention.

FIG. 7 represents a variant of embodiment of the iron of FIG. 1 in which the stainless steel sole 1 is replaced with an aluminum sole 101 with an enamel coating.

More particularly according to the invention, the bottom side of the sole 101 comprises a recess 110 comprising a flat bottom 110A set back relative to a sliding surface 111 extending along the perimeter of the sole 101, the sliding surface 111 representing around 45% of the total surface of the sole.

Advantageously, the bottom 110A of the recess 110 is set back by around 4 mm relative to the sliding surface 111. This relatively substantial depth of the recess 110 makes it possible to limit the amount of heat that the cloth receives by radiation due to the high emissivity of the enamel.

The bottom 110A is equipped with steam exit holes 112 that are connected, in a manner known per se, to a vaporization chamber built into the body of the iron or to a separate steam generator.

The recess 110 has an outer contour matching the contour of the sole 101 in the central area of said sole 101 in such a manner that, in this central area, the recess 110 is laterally bounded by a sliding surface 111 with a width of around 1 to 3 cm. On the back end of the sole 101, the recess 110 is bounded by a sliding surface 111 with a greater width of around 4 cm, making it possible to obtain a substantial sliding surface on the back end of the sole 101 for drying the cloth.

In a variant of the embodiment illustrated in dashed lines in FIG. 7, the rear portion of the sole 101 can also comprise a recess 120, different from the recess 110, with a depth of around 4 mm and equipped with steam exit holes 112, wherein the sliding surface 111 disposed between the recess 110 and the recess 120 contributes to the drying and scraping of the cloth.

Preference is given to the recess 110 having a constriction in the front portion of the sole 101, this constriction being formed by two protrusions 111A of the sliding surface 111 extending towards the interior of the recess 110.

The two protrusions 111A form a delimitation between a first group comprising around fifty steam exit holes 112 disposed in the bottom 110A in the central area of the sole and a second group comprising around ten steam exit holes 112A disposed in front of the two protrusions 111A, in proximity to the front tip of the sole 101.

The steam exit holes 112A are advantageously distributed in both the bottom of the recess 110A and in the vicinity of the sliding surface 111 of the front tip of the sole and are preferably supplied by a specific steam flow independent from the steam flow supplying the other steam exit holes 112 of the sole 101. This characteristic makes it possible to obtain a concentrated steam flow in the vicinity of the front tip of the sole 101 in order to thoroughly moisten an area of the cloth when performing precision work. The protrusions 111A in turn make it possible to increase the sliding surface coming into contact with the cloth behind the steam emission zone at the front tip of the sole 101, thus enabling a more effective drying of the cloth moistened by the steam exit holes 112A.

Obviously the invention is in no way limited to the embodiment described and illustrated herein, which was merely provided as an example. Modifications are possible, particularly in terms of the constitution of various elements or by substituting equivalent techniques, without in any way exceeding the scope of protection of the invention.

Hence in a variant of embodiment, the strip constituting the sliding surface may, in cross-section, have a curved surface rather than a flat surface so that the contact surface is reduced and so that the pressure exerted on the cloth by the sliding surface is increased even further.

Hence in a variant of embodiment not shown, the surface of the bottom of the recess can be non-planar or inclined relative to the sliding surface in such a manner that the depth of the recess varies relative to the zones of the sole. Such a characteristic thus makes it possible to obtain a different level of moistening of the cloth depending on the zone of the recess, wherein the cloth is moistened to a greater degree in the area where the recess is deepest. For example, the depth of the recess may be greater towards the front tip of the sole and progressively decrease towards the back end of the sole.

The invention claimed is:

1. A steam iron comprising a sole having a top side in thermal contact with a heating element and a bottom side with a sliding surface for contact with cloth and comprising at least one recess supplied with steam, said recess being bounded on its entire periphery by the sliding surface in such a manner that the recess forms a steam diffusion cavity that is surrounded by the sliding surface when the sole is applied to the cloth being ironed, wherein the sliding surface represents less than 50% of the total surface of the bottom side of the sole.

2. Steam iron as in claim 1, wherein the recess comprises a bottom constituted by a flat surface having steam exit holes therein.

3. Steam iron as in claim 1, wherein the sliding surface is not equipped with steam exit holes.

4. Steam iron as in claim 1, wherein the sliding surface represents between 30 and 45% of the surface of the bottom side of the sole.

5. Steam iron as in claim 1, wherein the sliding surface borders the sole.

6. Steam iron as in claim 5, wherein said sliding surface is constituted by a flat strip extending along a contour of the sole.

7. Steam iron as in claim 6, wherein said flat strip has a width less than 3 cm.

8. Steam iron as in claim 1, wherein said recess comprises a steam emission zone in a front tip of the sole having steam exit holes.

9. Steam iron as in claim 8, wherein the sliding surface of the sole comprises protrusions that locally reduce the surface of the recess behind the steam emission zone of the front tip of the sole.

10. Steam iron as in claim 1, wherein the sole comprises a single recess, said recess occupying a central position on said sole.

11. Steam iron as in claim 1, wherein the sole comprises a plurality of different recesses.

12. Steam iron as in claim 1, wherein the recess comprises protruding embossed elements, extending below the sliding surface of the bottom side, in the bottom of the recess, which come into contact with the cloth when the sole is applied to the cloth being ironed.

13. Steam iron as in claim 12, wherein said embossed elements are elongate in shape along the surface of the soleplate.

14. An ironing appliance comprising a pressurized steam generator connected by a steam line to a clothing iron, wherein said clothing iron comprises:

a sole having a top side in thermal contact with a heating element and a bottom side with a sliding surface for contact with cloth and comprising at least one recess supplied with steam, said recess being bounded on its entire periphery by the sliding surface in such a manner that the recess forms a steam diffusion cavity that is surrounded by the sliding surface when the sole is applied to the cloth being ironed, wherein the sliding surface represents less than 50% of the total surface of the bottom side of the sole.

* * * * *